US006152754A

United States Patent [19]

Gerhardt et al.

[11] Patent Number: 6,152,754

[45] Date of Patent: Nov. 28, 2000

[54] CIRCUIT BOARD BASED CABLE CONNECTOR

[75] Inventors: Thomas J. Gerhardt, Littleton, Colo.; Yassir Abdul-Hafiz, Irvine, Calif.

[73] Assignee: Masimo Corporation, Irvine, Calif.

[21] Appl. No.: 09/470,401

[22] Filed: Dec. 21, 1999

[51] Int. Cl.[7] ..... H01R 13/62

[52] U.S. Cl. ..... 439/325; 439/948; 439/951

[58] Field of Search ..... 439/325, 327, 439/347, 76.1, 630, 948, 951, 77, 493, 909

[56] References Cited

U.S. PATENT DOCUMENTS

| | | | |
|---|---|---|---|
| 3,710,303 | 1/1973 | Gallager, Jr. et al. | 439/593 |
| 4,490,003 | 12/1984 | Robinson | 439/325 |
| 4,797,125 | 1/1989 | Malana | 439/729 |
| 4,838,808 | 6/1989 | Fujiura | 439/357 |
| 4,961,711 | 10/1990 | Fujiura et al. | 439/357 |
| 5,295,852 | 3/1994 | Renn et al. | 439/328 |
| 5,302,133 | 4/1994 | Tondreault | 439/157 |
| 5,407,368 | 4/1995 | Strand et al. | 439/729 |
| 5,411,402 | 5/1995 | Bethurum | 439/77 |
| 5,498,235 | 3/1996 | Flower | 604/20 |
| 5,509,823 | 4/1996 | Harting et al. | 439/607 |
| 5,645,440 | 7/1997 | Tobler et al. | 439/160 |
| 5,797,771 | 8/1998 | Garside | 439/610 |
| 5,934,925 | 8/1999 | Tobler et al. | 439/325 |

*Primary Examiner*—Brian Sircus
*Assistant Examiner*—Son V. Nguyen
*Attorney, Agent, or Firm*—Knobbe, Martens, Olson & Bear, LLP

[57] ABSTRACT

A circuit board based cable connector is disclosed for use with a sensor connector tab to establish electrical signal connection between a sensor and a monitor or processor. The connector comprises a housing which encloses a circuit board. A slot is formed through a leading edge of the housing to allow insertion of the connector tab. A release mechanism releasably secures the connector tab within the housing. The circuit board is positioned adjacent and generally parallel to the inserted connector tab. Traces are formed on the side of the circuit board opposite the connector tab and establish electrical connection between wires of a cable and connector arms of the circuit board. A ground plane is formed on the tab side of the circuit board and, together with the flexible shield, provides an EMI shielding envelope. The connector arms extend generally parallel to the circuit board and are bent at their free ends to form dips. Slots formed through the circuit board are adapted to receive the dipped contact arm ends. The contact arm dips extend through the slots and into contact with electrical contacts of the connector tab, establishing an electrical connection. The connector tab is easily removed by actuating the release mechanism.

31 Claims, 12 Drawing Sheets

CIRCUIT BOARD BASED CABLE CONNECTOR

BACKGROUND OF THE INVENTION

1. Field of the Invention

The present invention relates to electrical connectors and more specifically to an electrical connector for connecting medical sensors to instruments responsive to signals from the sensors.

2. Description of the Related Art

Energy is often transmitted through or reflected from a medium to determine characteristics of the medium. For example, in the medical field, instead of extracting material from a patient's body for testing, light or sound may be generated and transmitted. Detection of the transmitted signal allows determination of information about the material through which the signal has passed. For example, the body's available supply of oxygen, or the blood oxygen saturation, is often monitored. Oxygen saturation is often determined by measuring light transmitted (or reflected) through a portion of the body, for example a finger or earlobe.

Durable and disposable sensors are often used for such physiological measurements. These sensors have connectors which allow detachment from the instrument or detachment from a cable connected to the instrument.

Since the sensors are very sensitive, it is important that the connector not add noise to the signal. Also, a secure connection between the sensor and the connector is required to sufficiently transfer the signal in a durable and reliable way. A plurality of wires are used to conduct various portions of the signal and to provide electrical energy to the sensor. Accordingly, it is necessary for the connector to be aligned such that the correct wires match the correct contacts of the connector.

SUMMARY OF THE INVENTION

Accordingly, the present invention involves a connector that is configured to attach sensors to instruments (typically via cables) that are responsive to signals from the sensors. In a preferred embodiment, to ensure proper operation, the connector is designed to prevent incorrect attachment of the sensor to the connector. Additionally, the connector allows for easy connection and release, yet inhibits accidental disconnection. Advantageously, the connector does not add significant noise to the system, and can be protected by shielding. Additionally, the connector and sensor tab are not sharp and do not contain protrusions that might hurt or scratch the patient.

A preferred embodiment having features in accordance with the present invention includes an electrical connector for use with a sensor plug having a plurality of signal contacts. The connector has a housing having a passageway configured to accept the insertion end of the sensor plug. A circuit board is disposed in the housing adjacent the passageway. A first side of the circuit board faces the passageway and a second side is opposite the first side. Conductive arms extend from the second side. In one embodiment, the conductive arms are in electrical communication with contacts or signal lines (traces) formed on or in the circuit board. Slots are formed through the circuit board and are each positioned to correspond to at least one arm. At least one of the arms has a contact segment adapted to fit through a corresponding slot to extend the arm from said first side and establish electrical contact with a signal contact of the sensor plug.

In another preferred embodiment having features in accordance with the present invention, an electrical connector for use with a sensor plug is disclosed. The sensor plug has a plurality of signal contacts and a locking hole locking indentation or catch at an insertion end. The connector has a housing having a passageway configured to accept the insertion end of the sensor plug. A stop member positioned within the housing passageway prevents insertion of the sensor beyond a defined limit. The connector has a locking mechanism adapted to releasably secure the sensor plug in the connector. The locking mechanism has a pair of buttons disposed on opposite sides of the connector and connected by a flexible bar. In one embodiment, a latch pin adapted to fit into the sensor plug locking hole depends from the flexible bar. Alternatively, a latch engages a catch on the sensor plug or a locking indentation. When the buttons are urged toward each other, the bar bows away from the sensor plug, thus linearly moving the latch pin out of the sensor plug locking hole.

Another preferred embodiment having features in accordance with the present invention includes an electrical connector for use with a sensor plug having a plurality of signal contacts. The connector includes a housing with a passageway configured to accept at least an insertion end of the sensor plug. A circuit board is disposed adjacent the passageway and has a plurality of conductive arms in communication with traces leading to wire contact points. Each arm has a first end connected to an arm contact point on the circuit board and extends generally parallel to the board along a side opposite the passageway to a second end. The circuit board has a plurality of slots formed therethrough and corresponding to the arm second ends. At least one of the arms has a curved portion at its second end which is adapted to extend through the corresponding circuit board slot and establish electrical contact with a signal contact of the sensor plug.

In yet preferred embodiment having features in accordance with the present invention, an electrical connector is provided for use with a sensor plug having a plurality of signal contacts. The connector comprises a housing having a passageway configured to accept at least an insertion end of the sensor plug and a circuit board disposed in the housing adjacent the passageway. Contacts extend from the circuit board and are in electrical communication with wire contact points formed on the circuit board. Each contact has a contact end adapted to make electrical contact with at least one of the signal contacts of the sensor plug. An electromagnetic shield substantially encircles the circuit board and is grounded.

For purposes of summarizing the invention and the advantages achieved over the prior art, certain objects and advantages of the invention are described. Of course, it is to be understood that not necessarily all advantages may be achieved in accordance with any particular embodiment of the invention. Thus, for example, those skilled in the art will recognize that the invention may be embodied or carried out in a manner that achieves or optimizes one advantage or group of advantages as taught without necessarily achieving other objects or advantages as may be taught or suggested. The invention is not limited to any particular preferred embodiment(s) disclosed.

DETAILED DESCRIPTION OF THE PREFERRED EMBODIMENT

Figure 1:
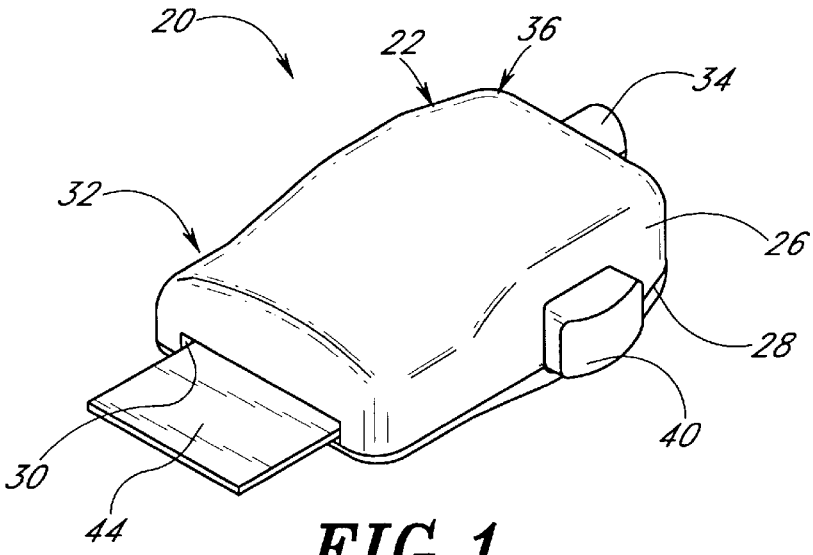
FIG. 1 is a perspective view of a connector having features in accordance with the present invention and having a sensor tab connector inserted.
Figure 2:
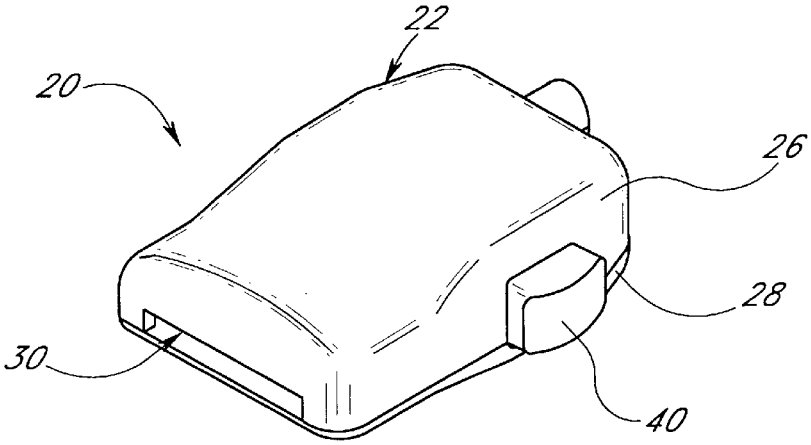
FIG. 2 is a perspective view of the connector of FIG. 1 without the tab inserted therein.
Figure 3:
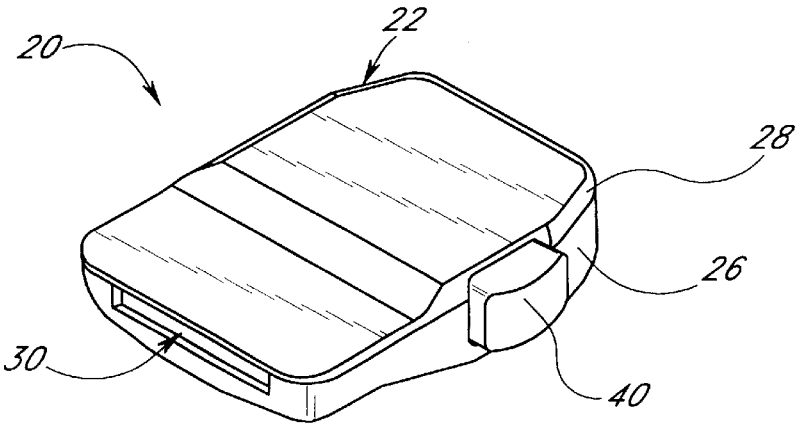
FIG. 3 is another perspective view of the connector of FIG. 2.

With reference to FIGS. 1–3, perspective views of an electrical connector 20 having features in accordance with the present invention are disclosed. The connector 20 comprises a housing or shroud 22 having top and bottom shells 26, 28. Buttons 40 extend through either side of the shroud 22. A slot 30 is formed through a leading edge 32 of the shroud 22 and a cable hold 34 is formed on a back edge 36 of the shroud 22. Advantageously, a cable disposed in the cable hold 34 connects on one end to contacts within the shroud 22 and on the other end to a monitor or processor. The shroud 22 preferably tapers from the back edge 36 to the leading edge 32 such that the back edge 36 has a greater height than the leading edge 32.

The slot 30 is adapted to receive a sensor connector tab 44 as shown in FIG. 1. Electrical connections between the connector 20 and the sensor connector tab 44 are made within the shroud 22. As such, the shroud 22 protects these electrical connections. The shroud also encloses a shielding apparatus for shielding the electrical connections from electromagnetic interference (EMI).

Figure 4:
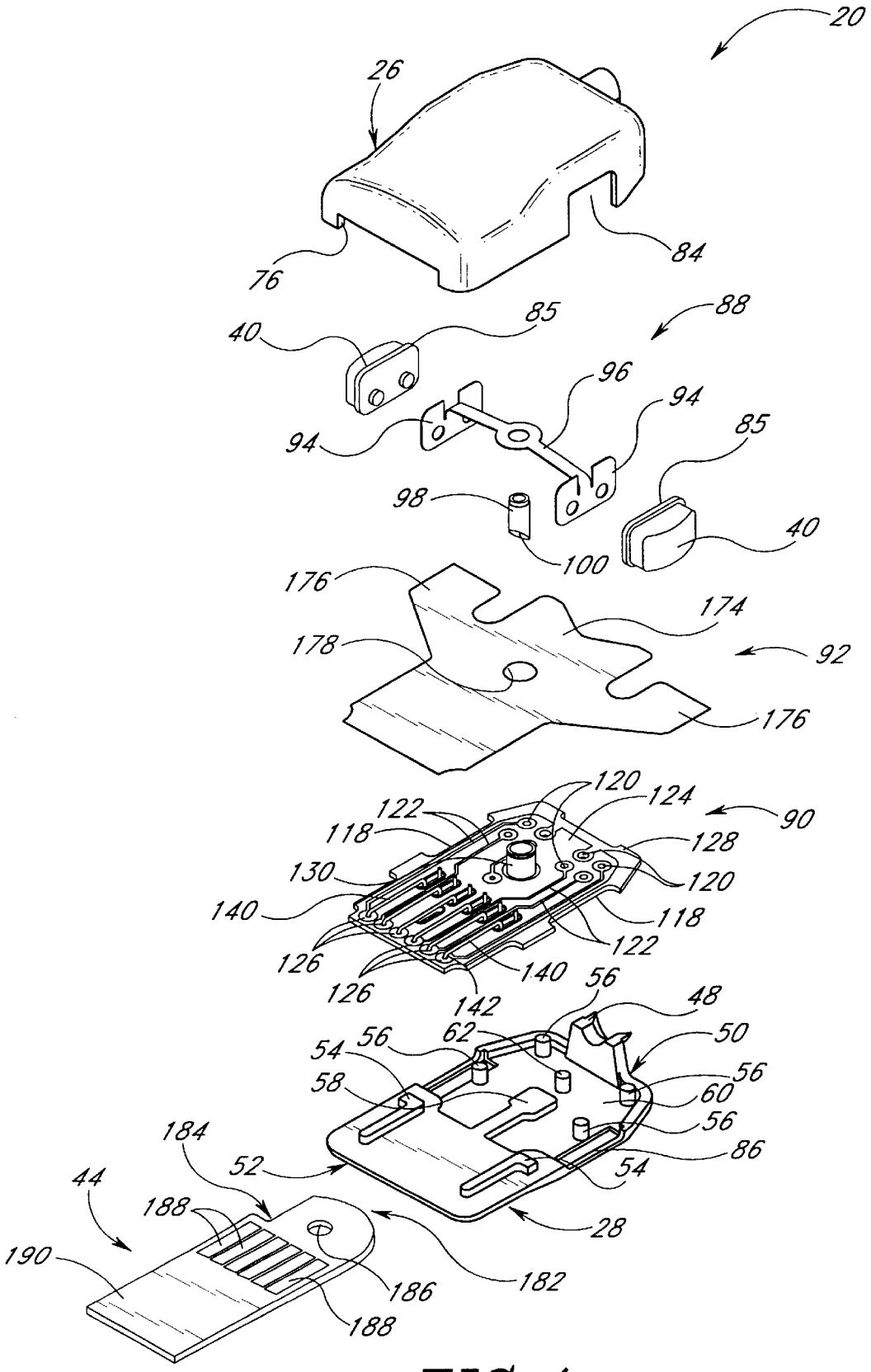
FIG. 4 is an exploded perspective view of the connector of FIG. 2.
Figure 5:
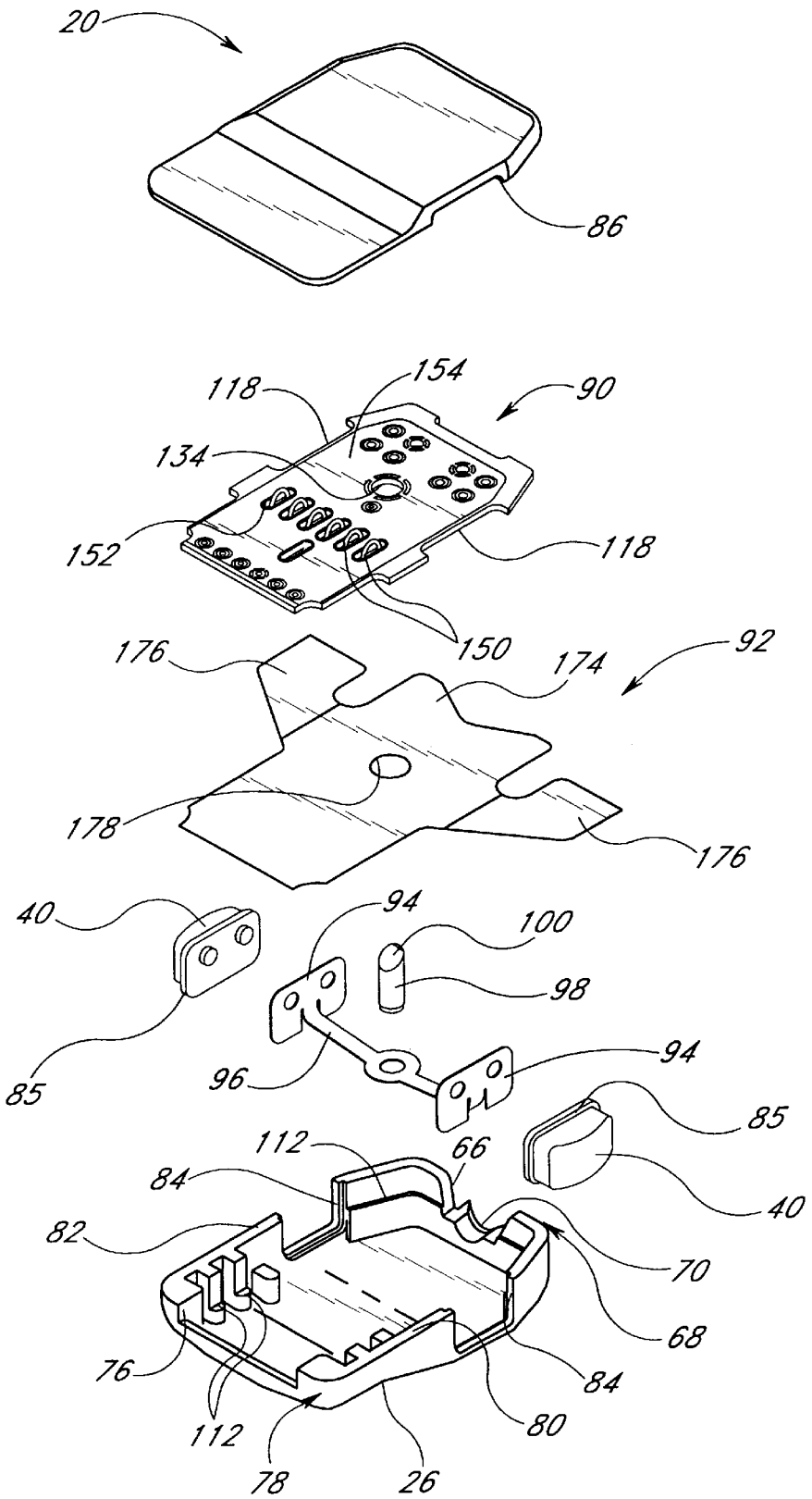
FIG. 5 is another exploded perspective view of the connector of FIG. 2.

FIGS. 4 and 5 depict exploded views of a preferred embodiment of the connector 20 of the present invention. The bottom shell 28 has a cable mount 48 at the center of a back edge 50. The cable mount 48 is used to secure a cable, as described further below. Although depicted in the middle of the back edge 50, the cable mount 48 can be positioned to one side or the other in alternative embodiments. Toward a leading edge 52 of the lower shell 28 are a pair of L-shaped guides 54. The guides 54 function to guide a sensor connector tab 44 when such a tab is inserted into the connector 20. The guides 54 also support a printed circuit board (PCB) 90 positioned within the housing. A plurality of positioning members 56 facilitate positioning of the sensor connector tab 44 within the connector 20 and mating of the bottom shell 28 with the top shell 26. In the illustrated embodiment, the positioning members 56 are posts; however, other suitable structures may be used A central support ridge 58 protrudes from an inner face 60 of the lower shell 28 and supports the connector tab when it is inserted into the connector 20. A stop post 62 prevents the sensor tab from being inserted too far into the connector 20.

As illustrated in FIG. 5, the top shell 26 has a back slot 66 formed at a back edge 68 and a cable mount 70 in the back slot 66. The bottom shell cable mount 48 fits complementarily into this back slot 66 and a cable preferably fits through and is secured between the opposing cable mounts 70, 48 of the top and bottom shells 26, 28. A slot 76 is formed in a leading edge 78 of the top shell 26 and, when the top shell 26 and the bottom shell 28 are attached to each other, the slot 76 forms the enclosed slot 30 shown in FIGS. 1–3.

As illustrated in FIGS. 4 and 5, each side edge 80, 82 of the top shell 26 has a U-shaped button cavity 84. The button cavities 84 allow the release buttons 40 to protrude from the side edges 80, 82 of the top shell 26. A ridge 85 is formed about the base perimeter of each button 40. When the buttons 40 are installed in the housing 22, the ridge 85 is disposed behind the associated shell edge 80, 82 to retain the button 40 within the housing 22. Although the top shell button cavities 84 encircle much of the buttons 40, similar button cavities 86 formed in the bottom shell 28 are sized and adapted to encircle the portion of the buttons 40 not encircled by the top shell button cavities 84.

The top and bottom shells of the housing 22 enclose a release mechanism 88 and a circuit board 90. The circuit board 90, which is discussed in more detail below, is wrapped with an electromagnetic shield 92 to protect the circuit board 90 and electrical connections from electromagnetic noise. The release mechanism 88 comprises the pair of buttons 40 connected via tabs 94 to a flat spring backbone 96. A locking post or latch pin 98 depends from a center of the spring backbone 96 and has an inclined surface 100 formed on a locking end. The release buttons 40 fit within the button cavities 84, 86 formed in the top and bottom shells 26, 28. Operation of the release mechanism 88 is discussed in more detail below.

Alignment supports 112 are formed along the inner periphery of the top shell 26, which is generally complementary to the edge profile of the circuit board 90. Thus, the circuit board 90 securely fits into the top shell 26 and correct alignment of the board is maintained by the ridges 112. The circuit board has indentations 118 on opposite edges corresponding to the location of the button cavities 84, 86. These indentations 118 allow the buttons 40 to be depressed into the shell without contacting or interfering with the circuit board 90.

The top shell 26 and bottom shell 28 are preferably glued, sonically welded or otherwise bonded together along the edges. It should be appreciated, however, that other methods of attachment may be used. Advantageously, the shroud 22 is made of plastic resin or the like.

FIGS. 6–9 show perspective views of the circuit board 90. The circuit board 90 is preferably a printed circuit board manufactured in a known manner. Wire connection pads 120 are electrically coupled to traces 122 which are formed on a top side 124 of the board 90 and extend to connector points 126. Advantageously, the connector points 126 comprise through-plated holes extending through the circuit board 90 and surrounded by solder pads. A ground trace 128 extends along the periphery of the top side 124 of the board.

A hollow cylindrical pylon or bushing 130 press-fits into a hole 134 which is formed generally centrally in the board 90 and communicates with a ground layer 131. Thus, the bushing 130 is electrically connected to ground. The ground layer 131 is formed along a bottom side 154 of the circuit board 90 and is mostly covered by a nonconductive pad 132. The edges of the bushing 130 are flared once the bushing is fit through the hole. Thus, the fit of the bushing 130 in the hole 134, and the bushing's connection to ground, is held secure.

Figure 6:
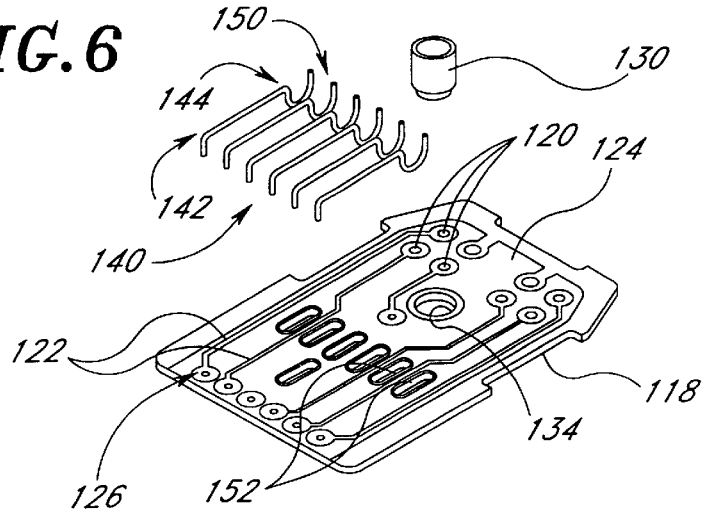
FIG. 6 is an exploded view of a circuit board having features in accordance with the present invention.
Figure 7:
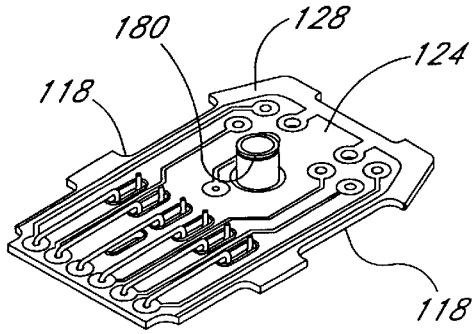
FIG. 7 is a perspective view of the circuit board of FIG. 6.

As shown in FIGS. 6 and 7, contact arms 140 are soldered to the connector points 126. The arms 140 are preferably formed of an 18 mil beryllium copper wire, but may be formed of any springable conductive material such as steel or brass. Additionally, the arms 140 may be round or flat and constructed by any method, such as being pulled through a die or etched from a flat sheet. The contact arms 140 are bent about 90° at a first end 142 in order to extend through the circuit board to facilitate soldering to the connector points 126, and to allow the arms 140 to extend substantially parallel to the circuit board 90. A second end 144 of each contact arm 140 is bent, forming a dip 150. Slots 152 formed through the circuit board 90 are complementary to the contact dips 150 and are adapted to allow the dips to extend therethrough without touching the circuit board 90.

Figure 8:
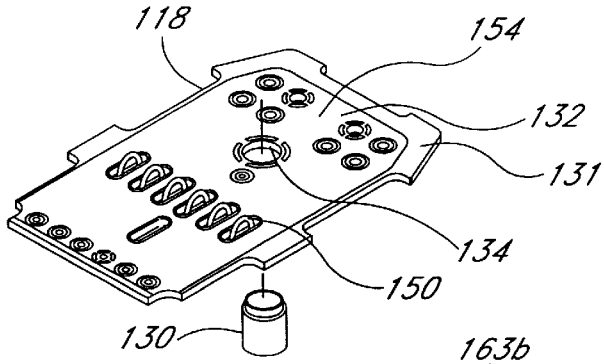
FIG. 8 is another perspective view of the circuit board of FIG. 6.

FIG. 8 depicts the bottom side 154 of the circuit board 90 with the contact arms 140 in place. As shown, the contact dips 150 extend through the slots 152 and protrude from the bottom side 154. This construction of the contact arms 140 allows the arms 140 to flex when a force is applied to the dip 150 of the arm. The flex is of a low magnitude, minimizing fatigue that may result from repeated flexing.

Figure 9:
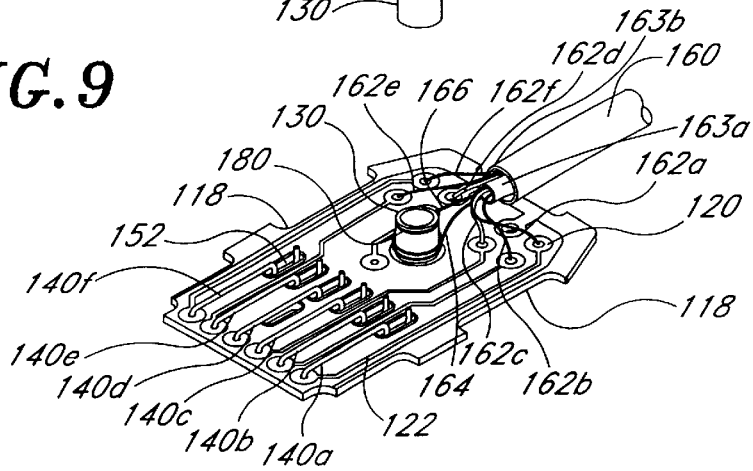
FIG. 9 is a perspective view of the circuit board of FIG. 6 connected to a cable and wires.

FIG. 9 illustrates the cable 160, which includes a plurality of wires 162 soldered to the connections 120 to electrically communicate through the traces 122 with the contact arms 140. A pair of cords 164, 166 are preferably disposed within the cable 160. The cords 164, 166 are wrapped around the central bushing 130; one 164 wrapped clockwise and the other 166 wrapped counterclockwise. An epoxy glue or the like secures the cords to the bushing 130. In this manner, the cords 164, 166 absorb tension in the cable 160 resulting from normal handling or hanging so that the wires 162 are substantially free from tension.

With continued reference to FIG. 9, a pair of wires 162*a*, 162*b* are adapted to electrically conduct the signal of the attached oxygen sensor. These wires communicate through contact arms 140*a* and 140*b*, respectively, with signal traces of the attachable sensor. A ground wire 162*c* communicates through contact arm 140*c* with the ground trace of the attachable sensor tab and also communicates with an inner cable shield 163*a* which surrounds the sensor wires 162*a*, 162*b* within the cable 160. An outer ground wire 162*d* is connected to outer shielding 163*b* of the cable 160. The outer cable shielding 163*b* surrounds all of the wires within the cable 160. The outer ground wire 162*d* electrically communicates with the ground layer 131 of the circuit board 90 and with the ground contact arm 140*d*. Another pair of wires 162*e*, 162*f* supply power to the attachable sensor. The power wires 162*e*, 162*f* communicate with the sensor through corresponding contact arms 140*e*, 140*f*. The power wires 162*e*, 162*f* run within the outer shielding 163*b* of the cable, but outside of the inner shielding layer 163*a*. In this manner, electrical noise or "cross-talk" between the power wires 162*e*, 162*f* and the signal wires 162*a*, 162*b* is minimized.

Figure 10:
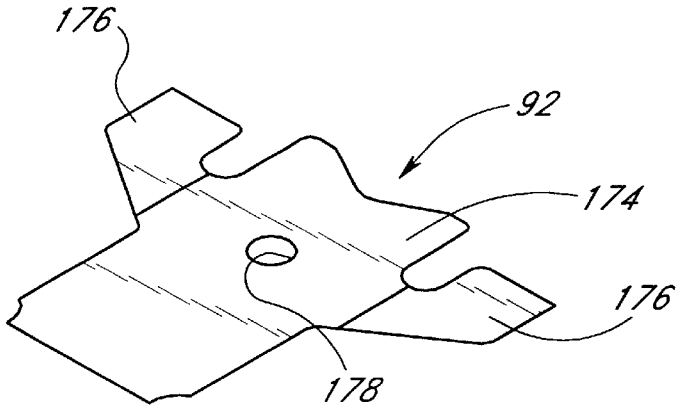
FIG. 10 is a perspective view of a shield having features in accordance with the present invention.
Figure 10A:
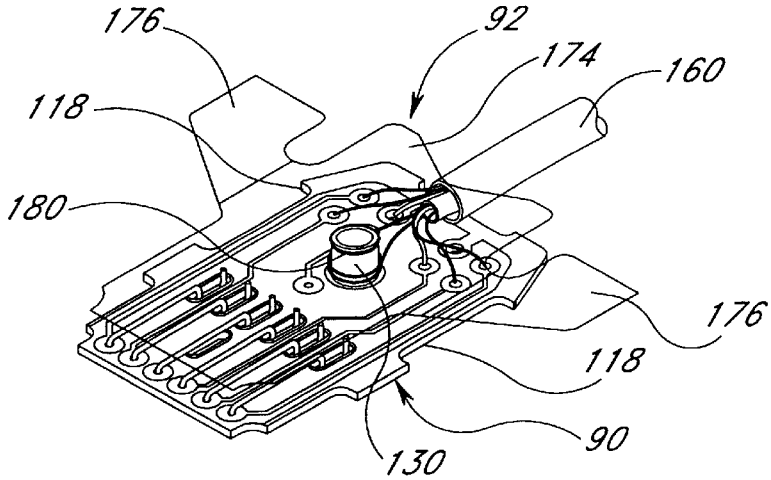
FIG. 10A is a top perspective view of the shield of FIG. 10 superimposed upon the circuit board of FIG. 9.
Figure 10B:
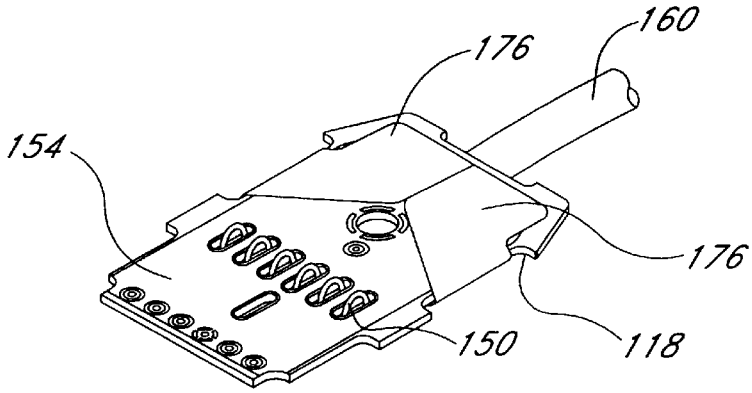
FIG. 10B is a bottom perspective view of the circuit board of FIG. 9 with the shield of FIG. 10 installed.

As depicted in FIGS. 10, 10A and 10B, the shield 92 wraps about the circuit board 90 to enclose the circuit board 90 and shield the electrical connections from electromagnetic noise. The shield 92 preferably has a copper top layer about one-half mil thick and a KAPTON™ (polyimide) bottom layer about one mil thick. Other materials and thicknesses may be used to construct a suitable electromagnetic shield.

As illustrated in FIGS. 10 and 10A, the shield 92 preferably has a main body 174 shaped to roughly correspond to the profile of the circuit board 90. Wings 176 extend from either side of the shield main body 174 and are adapted to fit within the circuit board button indentations 118 and wrap around the circuit board 90 to enclose a portion of the bottom side 154 of the circuit board 90 including the wire connections 120 as shown in FIG. 10B. The wings 176 are preferably fastened to the circuit board with pressure sensitive adhesive.

A hole 178 is formed in the shield 92 and corresponds to the circuit board bushing 130. The bushing 130 has an annular groove 180 formed towards a free end. The shield 92 fits over the bushing 130 and an edge of the shield hole 178 is captured within the bushing groove 180. The bushing groove 180 is preferably about 5 mil deep and 5 mil wide. Once the shield 92 is captured within the groove 180, it is soldered into place, electronically connecting the shield to the ground trace.

The shield 92, when wrapped around the circuit board 90, combines with the ground layer 131 to create a shielding envelope about the wire connections 120, traces 122 and contact arms 140. Thus, these sensitive components are shielded from electromagnetic noise.

It is to be understood that other methods and apparatus for shielding can be used to create an electromagnetic shield envelope around the connections of the present device. For example, the inner surface of the connector's top and bottom shells 26, 28 can be coated with a conductive shielding paint. Additionally, known methods of placing conductive, shielding inserts within the connector 20 are acceptable.

Figure 11A:
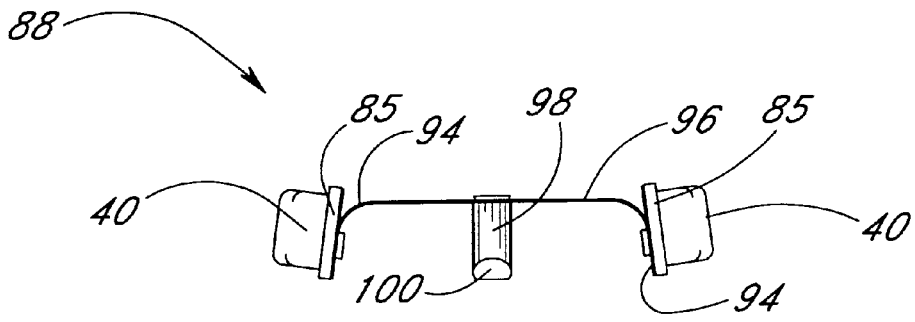
FIG. 11A is a plan view of a release mechanism having features in accordance with the present invention.
Figure 11B:
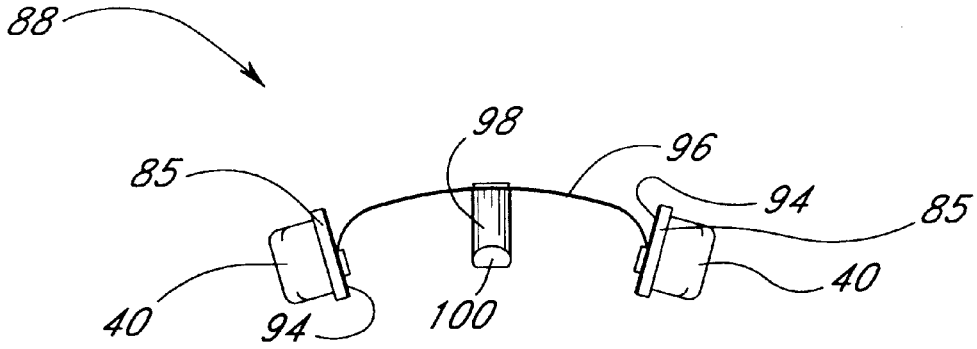
FIG. 11B is a plan view of the release mechanism of FIG. 11A flexed in an unlocked position.

FIGS. 11A and 11B detail the operation of the latching mechanism 88. FIG. 11A shows the latching mechanism 88 in a relaxed position. As discussed above, the buttons 40 are attached to tabs 94, which form part of a flat spring backbone 96 extending between the tabs 94. The latch pin 98 depends from the backbone 96. When the buttons 40 are squeezed together as shown in FIG. 11B, the backbone 96 deflects, thus lifting the latch pin 98. It is to be understood that alternative apparatus may be employed to construct the spring backbone. For example, the backbone may comprise a pair of round, springable members connected to opposite sides of the latch pin, each member extending to an opposing button.

Figure 12:
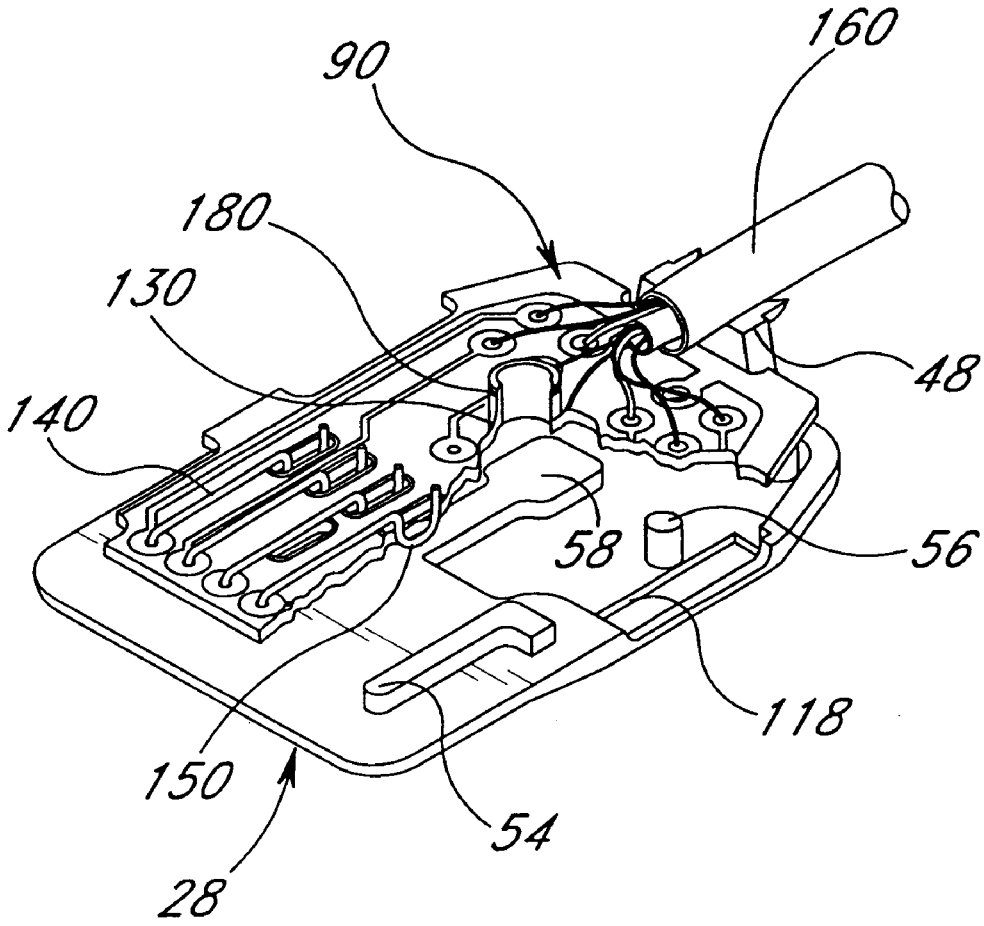
FIG. 12 is a perspective view of the circuit board of FIG. 9 partially cut away and positioned in the connector of FIG. 4.
Figure 13:
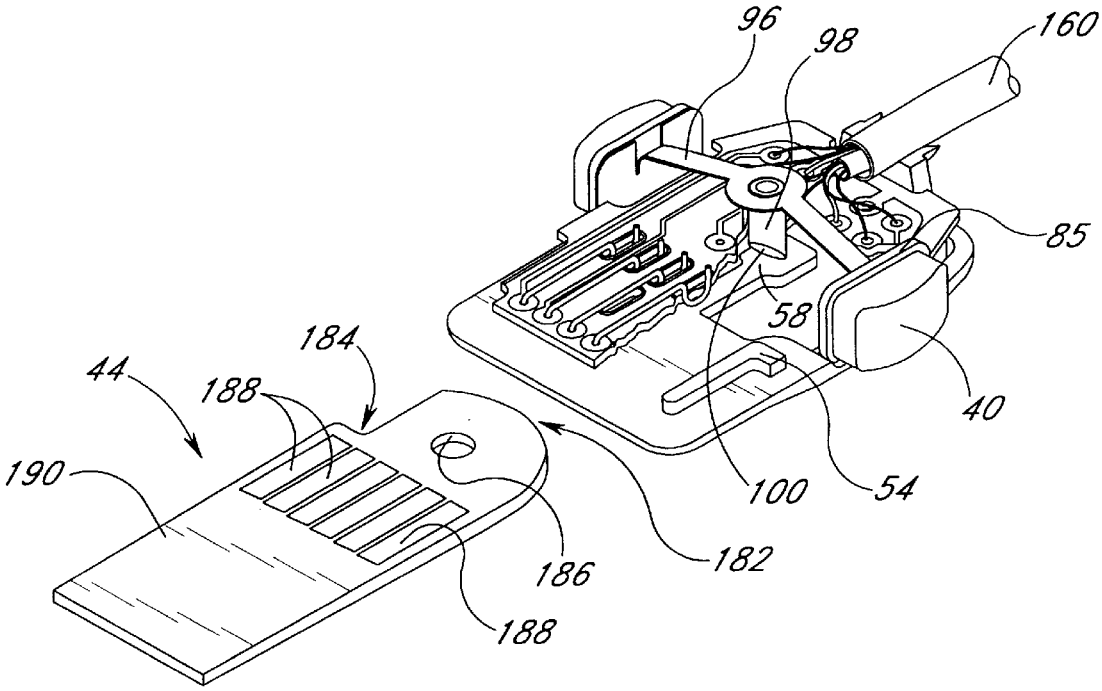
FIG. 13 is a perspective view of the assembly of FIG. 12 showing placement of the locking mechanism.
Figure 14:
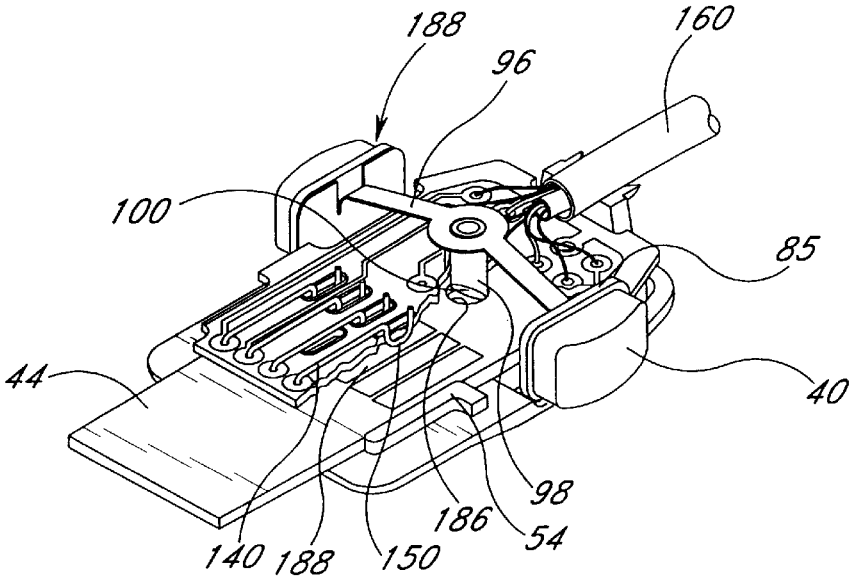
FIG. 14 is a perspective view of the assembly of FIG. 13 with the tab of FIG. 1 inserted.

FIGS. 12–14 provide various perspective views of the bottom shell 28 with a partially cut away circuit board 90 disposed therein. FIG. 12 shows the center bushing 130 partially cut away and FIGS. 13–14 show the release mechanism 88 in place relative to the bottom shell 28 and circuit board 90.

With particular reference to FIGS. 13 and 14, the sensor connector tab 44 preferably has a rounded leading edge 182 and a notch 184 formed at a side of the tab 44. A lock hole 186 is formed towards the leading edge 182. In the embodiment depicted in FIG. 13, the lock hole 186 extends completely through the tab 44. It should be understood that the lock hole 186 could also be merely a blocking indentation rather than a hole extending entirely through the sensor tab 44. As the connector tab 44 is slid into the connector 20, the leading edge 182 of the tab 44 contacts the inclined surface 100 of the release pin 98, pushing the pin 98 upwardly so that the tab 44 can slide thereunder. When the release pin 98 becomes aligned with the lock hole 186, it springs into the hole. When the release pin 98 hits the support ridge 58, an audible click is produced. The click indicates proper latching. Since the release pin 98 is inclined on only one side, the connector tab 44 cannot slide under the pin 98 in an outwardly-moving direction. Thus, with the latch pin 98 inserted in the lock hole 186 as shown in FIG. 14, the connector tab 44 is locked in place and may not be removed from the housing 22 unless the release mechanism 88 is actuated. As discussed above with reference to FIGS. 11A and 11B, when the buttons 40 are squeezed together, the latch pin 98 is lifted. When the latch pin 98 is lifted out of the sensor tab lock 186, the sensor tab 44 may be removed from the connector 20.

As depicted in FIGS. 12–13, the latch pin 98 of the release mechanism 88 fits slidably within the hollow bushing 130 (FIG. 10A). When the connector tab 44 is inserted into the connector 20, the bushing 130 lends stability to the latch pin 98. Because much of the body of the latch pin 98 remains within the hollow bushing 130, the bushing supports the latch pin 98 and keeps the latch pin 98 substantially perpendicular to the tab 44, even in the presence of forces tending to pull the tab 44 out of the connector. The tab support ridge 58 prevents the tab 44 from moving downwardly out of engagement with the latch pin 98.

A plurality of contacts 188 are formed on a top side 190 of the connector tab 44. These contacts 188 correspond to the contact arms 140 of the connector circuit board 90 and are adapted to make secure electrical contact therewith. As shown in FIG. 14, the contact arms 140 align with corresponding contacts 188 on the tab 44, which is guided into position by the tab guides 54. The contact arm dips 150 electrically connect each contact arm 140 with the corresponding sensor contact 188. Thus, the dip 150 acts as a contact segment of the arm. Preferably, a layer of EMI shielding material, such as the copper/polyimide material discussed above, is positioned on the tab 44 below the contacts 188 or on the opposite side of the tab 44. The tab shielding, when combined with the shield 92 discussed above, forms a shielding envelope completely surrounding the contact arms 140 and contacts 188 so as to prevent electromagnetic noise from interfering with the signal.

Figure 15A:
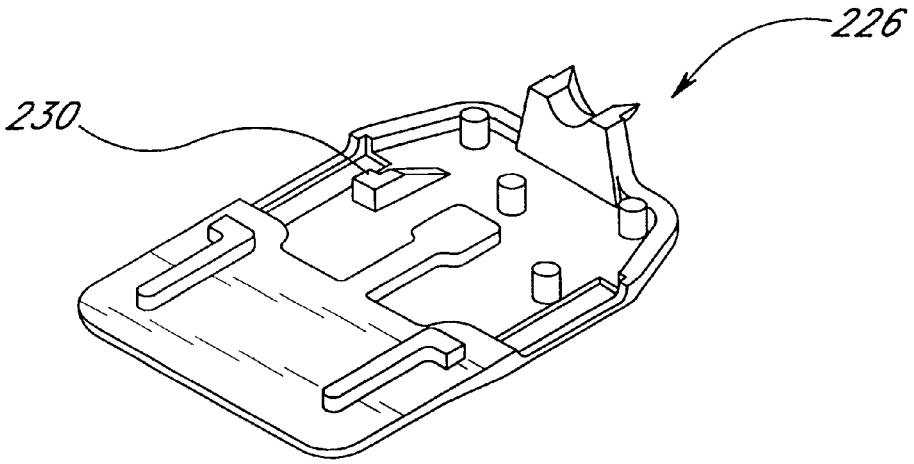
FIG. 15A is a perspective view of a bottom shell having features in accordance with a preferred embodiment of the present invention.
Figure 15B:
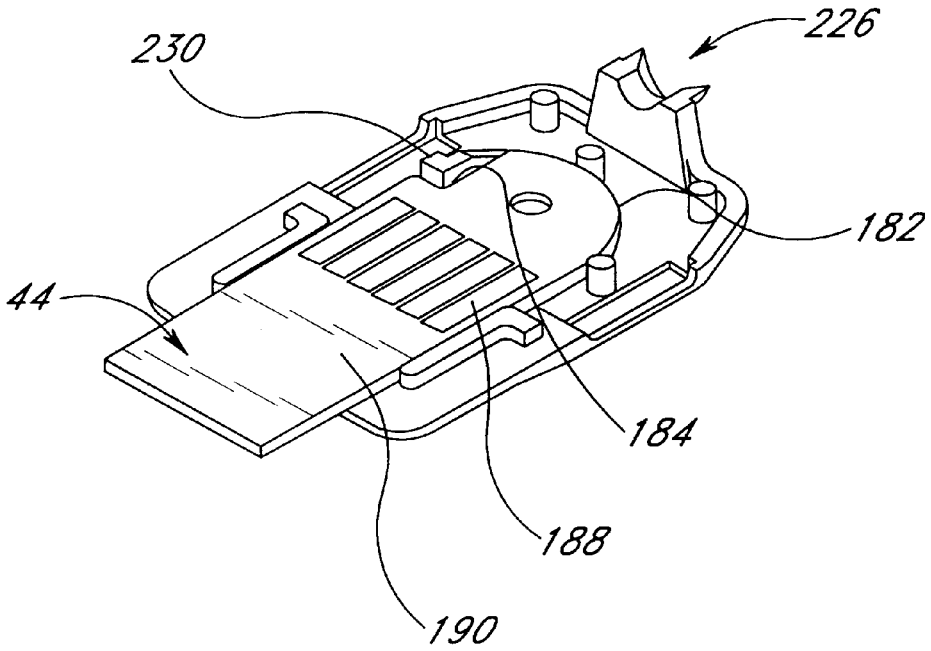
FIG. 15B shows the bottom shell of FIG. 15A with a sensor tab inserted.

Because the sensor tab 44 contacts 188 are formed on its top side 190, it is particularly important that the sensor tab 44 be inserted correctly into the connector 20. If operators are inattentive, however, there is a chance that the sensor tab 44 may be inserted upside down, preventing the desired electrical connection. As illustrated in FIGS. 15A and 15B, another preferred embodiment of a connector lower shell 226 having features in accordance with the present invention has a key boss 230 disposed on the inside of the lower shell 226. The key boss 230 extends towards the front of the shell 226 for a short distance. As discussed above, a key notch 184 is formed on an edge of the connector tab 44. As shown in FIG. 15B, when the tab 44 is inserted into the keyed lower shell 226, the key boss 230 fits into the key notch 184 of the sensor tab 44. If a sensor tab were to be inserted into the keyed lower shell 226 in an upside-down orientation, the leading edge 182 of the sensor tab 44 would contact the key boss 230, preventing the sensor tab 44 from being fully inserted in the connector 20. Thus, the connector tab 44 cannot be fully inserted into the connector 20 unless it is in the correct orientation.

Figure 16:
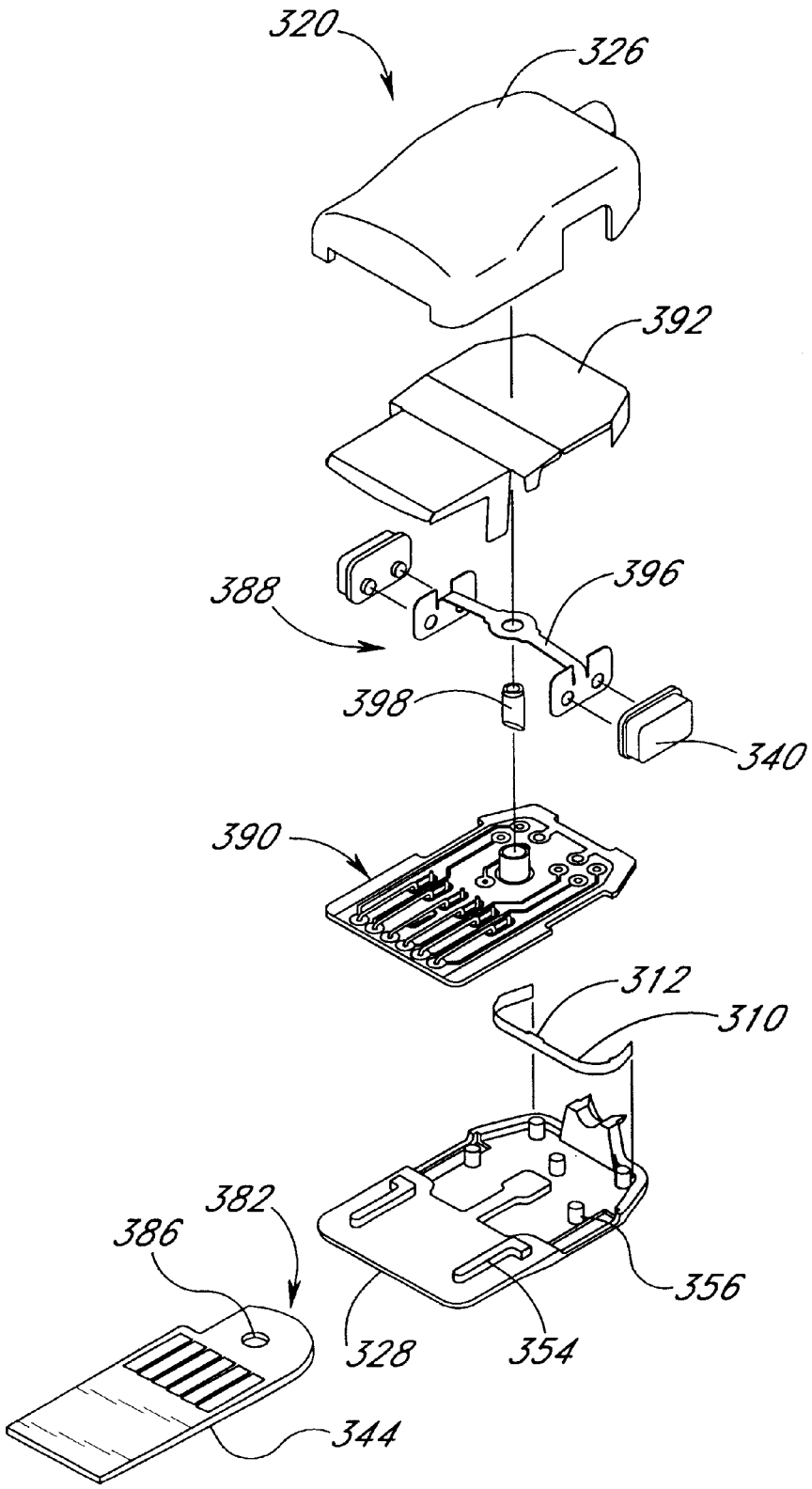
FIG. 16 is an exploded perspective view of another embodiment of a connector having features in accordance with the present invention.
Figure 17:
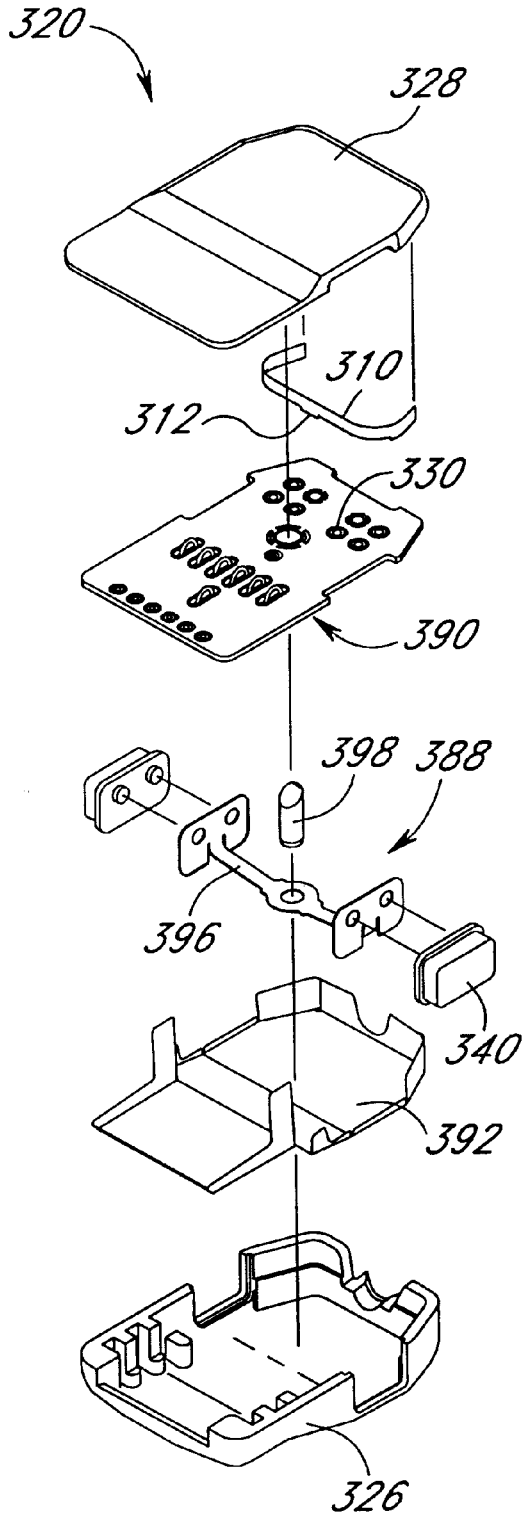
FIG. 17 is another exploded perspective view of the connector of FIG. 16.

FIGS. 16 and 17 illustrate another embodiment of a circuit board based connector 320 which includes an ejector spring 310 to assist removal of a sensor tab 344 from the connector. The connector 320 shares many similar components with the above-described connector 20. For example, the connector 320 includes a top shell 326 and a bottom shell 328 which enclose a printed circuit board 390. A shield 392 is wrapped around the printed circuit board 390. L-shaped guides 354 and positioning posts 356 are formed in the lower shell 328 and are adapted to guide the sensor connector tab 344 within the connector 320. A release mechanism 388 is adapted to releasably hold the connector tab 344 within the connector 320. The release mechanism 388 includes a spring backbone 396 attached to a locking post 398. The post 398 is adapted to fit through a hole 386 in the tab 344 in order to lock the tab in place. Buttons 340 are connected to the spring backbone 396.

The ejector spring 310 is preferably arranged in the lower shell 328 below the printed circuit board 390. A spacer 312 portion of the spring 310 extends outwardly and contacts the bottom surface of the printed circuit board 390. In this manner, the spacer 312 maintains the position of the spring 310 relative to the circuit board 390 and keeps other portions of the spring 310 out of contact with the circuit board 390. The spacer 312 is positioned so that as the spring 310 deflects and moves relative to the circuit board 390, the spacer 312 does not contact connector points 330 that are formed on the circuit board 390. Such contact could potentially cause an electrical short. Since the spacer 312 keeps other portions of the spring 310 out of contact with the circuit board 390, the spring 310 will not interfere with the connector points 330 and associated circuitry of the circuit board 390.

In operation, when the connector tab 344 is inserted into the connector 320, a leading edge 382 of the tab compresses the ejector spring 310. When the tab is fully inserted, the locking pin 398 holds the tab in place so that the spring 310 remains in the compressed state. When the release mechanism 388 buttons 340 are depressed, removing the locking pin 398 from the sensor tab 344, the ejector spring 310 decompresses, pushing the tab 344 out of the connector 320.

Figure 18:
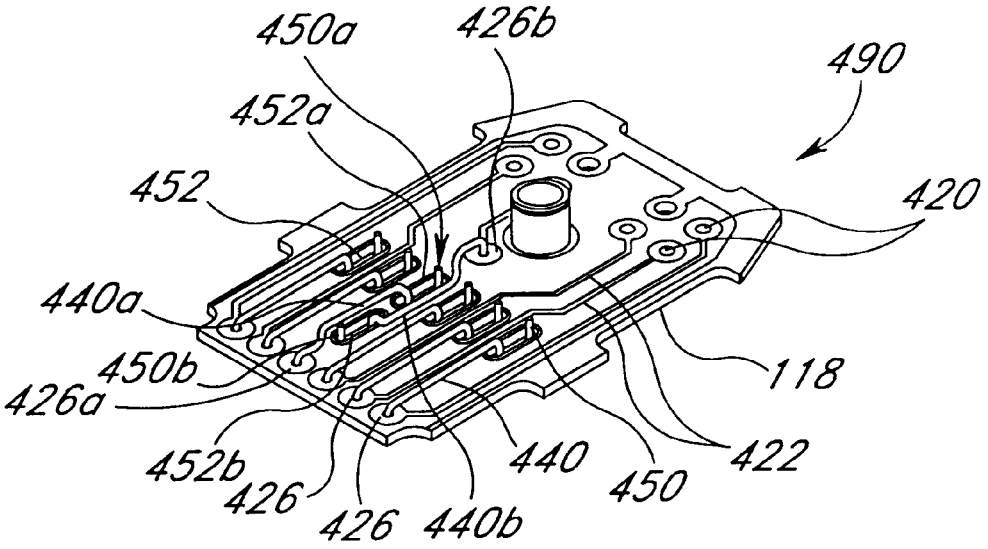
FIG. 18 is a perspective view of another embodiment of a circuit board adapted for use with a connector in accordance with the present invention.

FIG. 18 illustrates another embodiment of a printed circuit board 490 in which two of the contact arms 450 are adapted to connect to the same sensor tab contact so that the arms electrically communicate with each other when the tab is inserted into the connector. The circuit board 490 preferably shares similarities with the circuit board 90 discussed above. For example, a plurality of wire connectors 420 are provided and communicate through traces 422 with connecting points 426. Contact arms 440 extend from the connecting points and have dips 450 formed at an end opposite the connecting point 426. Slots 452 are formed through the circuit board 490 and the contact arm dips 450 are adapted to extend through the slots 452 and into contact with a sensor tab contact. The circuit board 490 is adapted for use in a connector 20 including a shroud or housing 22 similar to that described above.

A pair of slots 452*a*, 452*b* are formed through the circuit board 490 and are longitudinally aligned. A first contact arm 440*a*, which is preferably electrically connected to ground, extends from a first connecting point 426*a* to the first slot 452*a*. The contact arm 440*a* is curved so as to not to overlap the second slot 452*b*, which is positioned between the first connecting point 426*a* and the first slot 452*a*. A first dip 450*a* of the first contact arm 440*a* extends through the first slot 452*a*. A second contact arm 440*b* extends from a second connecting point 426*b* to the second slot 452*b*. As with the first contact arm 440*a*, the second contact arm 440*b* is curved so as to avoid interfering or overlapping the first slot 452*a*. The second dip 450*b* extends through the second slot 452*b*. The curved shape of the first and second contact arms 440*a*, 440*b* allows the arms to communicate with their respective slots 452*a*, 452*b* without interfering with each other. The respective contact arm dips 450*a*, 450*b* are aligned longitudinally so that they will electrically engage the same sensor tab contact 188 (see FIG. 14). Thus, the contact arms 440*a*, 440*b* are placed into electrical communication when the sensor tab is engaged with the connector 20.

The present arrangement is especially advantageous because the contact arms 440*a*, 440*b* are in electrical communication only when the sensor tab is correctly inserted into the connector 20. Thus, the contact arms 440*a*, 440*b* can be adapted to communicate a signal when the connector tab is correctly connected and can also be adapted to trigger an alarm to indicate an improper connection or to indicate that the connector tab has fallen out of the connector.

Figure 19:
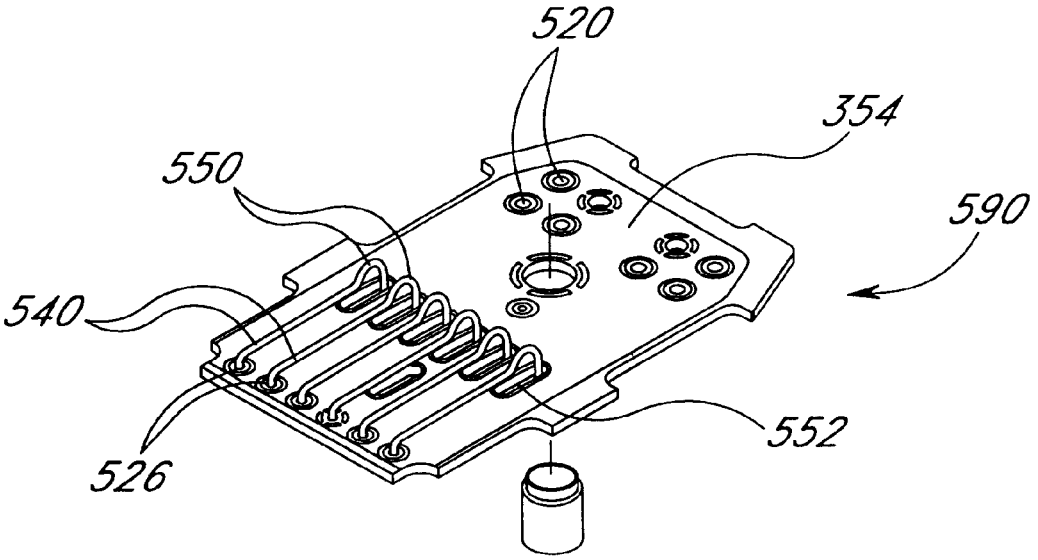
FIG. 19 is a perspective view of another embodiment of a circuit board adapted for use with a connector according to the present invention.

FIGS. 6–9 illustrates printed circuit board 90 which, as discussed above, includes contact arms 140 that extend generally parallel to the top surface 124 of the board. FIG. 19 shows another embodiment of a printed circuit board 590 which shares many similarities to circuit board 90, but includes contact arms 540 which extend generally parallel to a bottom side 554 of the circuit board 590 rather than the top side. As with the above-described circuit board 90, circuit board 590 is adapted to be included within a connector shroud 22 and includes connecting points 526 which are electrically connected to contact arms 540. The connecting points 526 communicate through traces, which are located on the top side of the circuit board, to wire connectors 520. The contact arms have dips 550 formed on their ends. The dips 550 are adapted to electrically engage contacts of a sensor tab that may be inserted into the connector. Slots 552 are formed through the circuit board 590 and are adapted to accommodate portions of the contact arm dips 550. Thus, when the contact arms bend when contacting the sensor tab, the contact arm dips 550 partially enter the slots 552 instead of contacting the bottom side 554 of the circuit board 590.

The circuit board 590 is preferably surrounded with a layer of shielding that surrounds the circuit board 590 and the contact arms 540 to create a shield envelope to prevent electromagnetic noise from entering the system. A proper shielding envelope may be created by providing shielding along the bottom and sides of the connector that includes the circuit board 590.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. An electrical connector for use with a sensor plug having a plurality of signal contacts, said connector comprising:

a housing having a passageway configured to accept an insertion end of the sensor plug;

a circuit board disposed in the housing adjacent the passageway and having a first side facing the passageway and a second side opposite the first side, said circuit board further having a plurality of slots formed through the circuit board; and a plurality of conductive arms extending from the first side, the arms in electrical communication with contacts formed in the circuit board, each of said arms having a contact segment extending partially through a corresponding one of said slots;

wherein said contact segment establishes electrical contact with a signal contact of the sensor plug.

2. The connector of claim 1, wherein the contact segment is rounded.

3. The connector of claim 2, wherein a free end of the contact arm is disposed adjacent the second side of the circuit board.

4. The connector of claim 1, wherein the sensor plug insertion end includes a key notch, and a key boss is disposed in the housing passageway and is adapted to fit into the key notch when the sensor plug is inserted into the connector.

5. The connector of claim 1, including an electromagnetic shield wrapped around the circuit board.

6. The connector of claim 1, wherein the connector is attached to a cable having a plurality of wires connected to wire contact points, and the circuit board includes a hollow bushing and the cable has at least one support cord which is wrapped at least once around the bushing and secured thereto.

7. The connector of claim 1, wherein the conductive arms are formed of beryllium copper wire.

8. The connector of claim 1, including traces formed on the second side of the circuit board and extending between said wire contact points and said contact arms.

9. The connector of claim 1, wherein a latch hole is formed near an insertion end of the sensor plug, and the connector further comprises a release mechanism adapted to releasably insert a latch pin into the latch hole.

10. The connector of claim 9, wherein the release mechanism comprises opposing buttons connected by a flexible bar having a latch pin depending therefrom.

11. The connector of claim 10, wherein portions of the buttons protrude from the housing.

12. The connector of claim 1, additionally comprising an electromagnetic shielding envelope substantially enclosing the circuit board and the sensor plug.

13. The connector of claim 1, wherein an electromagnetic shield is wrapped around the circuit board and is in electrical communication with a ground wire.

14. The connector of claim 13, wherein the sensor plug includes an electromagnetic shielding layer adjacent the sensor plug contacts.

15. The connector of claim 1, wherein a first and second slot of the plurality of slots are positioned to correspond to a single signal contact.

16. The connector of claim 15, wherein a first contact arm extends from a first contact point in the circuit board and has a first contact segment adapted to extend through the first slot, and a second contact arm extends from a second contact point in the circuit board and has a second contact segment adapted to extend through the second slot, and the second slot is positioned between the first contact point and the first slot and the first slot is positioned between the second contact point and the second slot, and the first and second contact arms are adapted to not interfere with each other.

17. An electrical connector for use with a sensor plug, said sensor plug having a plurality of signal contacts and a lock at an insertion end, said connector comprising:

a housing having a passageway configured to accept at least the insertion end of the sensor plug;

a stop positioned within the housing passageway and prevented insertion of the sensor beyond a limit; and a locking mechanism releasably secured the sensor plug in the connector, the locking mechanism comprising a pair of buttons disposed on opposite sides of the connector and having a flexible bar extending therebetween, and a latch pin fitting into a sensor plug lock, said latch pin extending from the flexible bar;

wherein the flexible bar bows when the buttons are urged toward each other, and bowing of the bar linearly moves the latch pin out of the sensor plug lock.

18. The connector of claim 17, further comprising a spring positioned between the stop member and the sensor plug insertion end.

19. The connector of claim 18, wherein the spring further comprises a spacer adapted to maintain the position of the spring.

20. The connector of claim 17, including a hollow central bushing disposed within the housing, and the latch pin is inserted through the hollow bushing.

21. The connector of claim 17, wherein the latch pin has an inclined surface formed at an end thereof.

22. The connector of claim 21, wherein the sensor plug and the latch pin are configured so that when the sensor plug is inserted into the connector sufficiently that the latch pin is aligned with the sensor plug lock, the flexible bar exerts a force urging the latch pin into the lock, and an audible click is created when the latch pin is forced into the lock.

23. The connector of claim 17, wherein the sensor plug insertion end includes a key notch, and a key boss is disposed in the housing passageway and is adapted to fit into the key notch when the sensor plug is inserted into the connector.

24. The connector of claim 23, wherein the key notch is formed along a side of the sensor plug insertion end.

25. The connector of claim 17, wherein the housing has a greater height at a back edge than at a leading edge, and the housing tapers from the back edge to the leading edge.

26. An electrical connector for use with a sensor plug having a plurality of signal contacts, said connector comprising:

a housing having a passageway configured to accept at least an insertion end of the sensor plug;

a circuit board disposed in the housing adjacent the passageway;

contacts extending from the circuit board, each contact having a contact end adapted to make electrical contact with at least one of said signal contacts;

an electromagnetic shield encircling the circuit board; and the shield has a main body covering a first side of the circuit board, and wings extending from the main body and wrapping around the circuit board and partially covering a second side of the circuit board.

27. The connector of claim 26, wherein the shield comprises a conductive outer layer and a nonconductive inner layer.

28. The connector of claim 25, wherein the outer layer is formed of copper and the inner layer is formed of polyimide.

29. The connector of claim 26, wherein the wings cover wire contact points.

30. The connector of claim 26, wherein a bushing having an annular channel formed therein is attached to the circuit board, and the shield has a hole formed through the main body, the hole fitting a pylon and the channel capturing an edge of the hole therein.

31. The connector of claim 26, wherein the shield comprises a layer of conductive paint applied to a surface of the housing.

* * * * *